US009358786B2

(12) United States Patent
Watanabe et al.

(10) Patent No.: US 9,358,786 B2
(45) Date of Patent: Jun. 7, 2016

(54) RECORDING HEAD

(71) Applicant: CANON KABUSHIKI KAISHA, Tokyo (JP)

(72) Inventors: Keiji Watanabe, Kawasaki (JP); Yoshinori Tagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/708,018

(22) Filed: May 8, 2015

(65) Prior Publication Data

US 2015/0328891 A1 Nov. 19, 2015

(30) Foreign Application Priority Data

May 14, 2014 (JP) ..... 2014-100913

(51) Int. Cl.
*B41J 2/14* (2006.01)
*B41J 2/16* (2006.01)

(52) U.S. Cl.
CPC ..... *B41J 2/1433* (2013.01); *B41J 2/14024* (2013.01); *B41J 2/14145* (2013.01); *B41J 2/162* (2013.01); *B41J 2/1623* (2013.01); *B41J 2202/11* (2013.01); *Y10T 156/10* (2015.01)

(58) Field of Classification Search
CPC ..... B41J 2/1433; B41J 2/162; B41J 2/1623; B41J 2/14024; B41J 2/14145; B41J 2002/11; Y10T 156/10
USPC ..... 347/20, 40, 44, 65, 71, 85
See application file for complete search history.

(56) References Cited

U.S. PATENT DOCUMENTS

2009/0212008 A1* 8/2009 Uyama ..... B41J 2/14145 216/27
2009/0309938 A1* 12/2009 Yoneda ..... B41J 2/1603 347/85

FOREIGN PATENT DOCUMENTS

JP 2006-035854 A 2/2006

* cited by examiner

*Primary Examiner* — Stephen Meier
*Assistant Examiner* — Alexander D Shenderov
(74) *Attorney, Agent, or Firm* — Canon U.S.A., Inc. IP Division

(57) ABSTRACT

A recording head having a substrate and a channel forming member configured to form a flow channel, a supply port formed at the substrate so as to penetrate through the substrate, the flow channel communicates with the supply port, and a member formed of an organic material and configured to connect two surfaces forming the supply port and opposing each other with the supply port interposed therebetween.

12 Claims, 12 Drawing Sheets

RECORDING HEAD

BACKGROUND OF THE INVENTION

1. Field of the Invention

This disclosure relates to a recording head having a substrate provided with a supply port.

2. Description of the Related Art

A recording apparatus represented by an inkjet printer includes a recording head. The recording head is a portion configured to discharge liquid or the like, and includes a substrate and a channel forming member configured to form a flow channel. The substrate is provided with a supply port formed so as to penetrate through the substrate.

In the related art, the recording head of this type has a problem of a deformation of the substrate. For example, in the case where a periphery of the substrate is sealed with a sealing material, the substrate may be deformed by contraction of the sealing material. The deformation of the substrate is not limited to be caused by the sealing material as described above, and may be caused by various environmental changes in the periphery. In particular, the probability of occurrence of deformation of the substrate is increased with an increase in length of the substrate. If the substrate is deformed, in the case where the channel forming member is formed on the substrate, a deformation of the channel forming member or separation of the channel forming member from the substrate may occur. Consequently, the flow channel is deformed, and hence recording accuracy may be lowered.

As a method of solving such a problem, an increase in rigidity of the substrate by increasing a size of the substrate is conceivable.

As another method of solving the problem, Japanese Patent Laid-Open No. 2006-35854 describes provision of a beam structure formed of silicone as part of a substrate in an interior of a supply port in the substrate.

If the size of the substrate is increased, the rigidity of the substrate is improved. However, the cost is increased correspondingly. The substrate is manufactured by forming the channel forming member or the like on a wafer and cutting out by means of dicing and the like. In other words, the larger the size of the substrate becomes, the less the number of substrates which may be cut out from one piece of wafer.

In contrast, the method of forming the beam structure formed of silicon in the interior of the supply port as described in Japanese Patent Laid-Open No. 2006-35854 achieves an improvement of the rigidity without changing the size of the substrate. However, since part of the substrate is remained as the beam structure simultaneously with the formation of a discharge port and the supply port, the manufacturing process becomes complicated, and hence the tendency of cost increase still remains.

SUMMARY OF THE INVENTION

This disclosure provides a recording head in which a deformation of a substrate is restrained with a simple method.

This disclosure provides a recording head having a substrate and a channel forming member configured to form a flow channel including a supply port formed so as to penetrate through the substrate, the flow channel communicates with the supply port, and a member formed of an organic material and configured to connect two surfaces forming the supply port and opposing each other with the supply port interposed therebetween.

Further features of the present invention will become apparent from the following description of exemplary embodiments with reference to the attached drawings.

DESCRIPTION OF THE EMBODIMENTS

Figure 1:
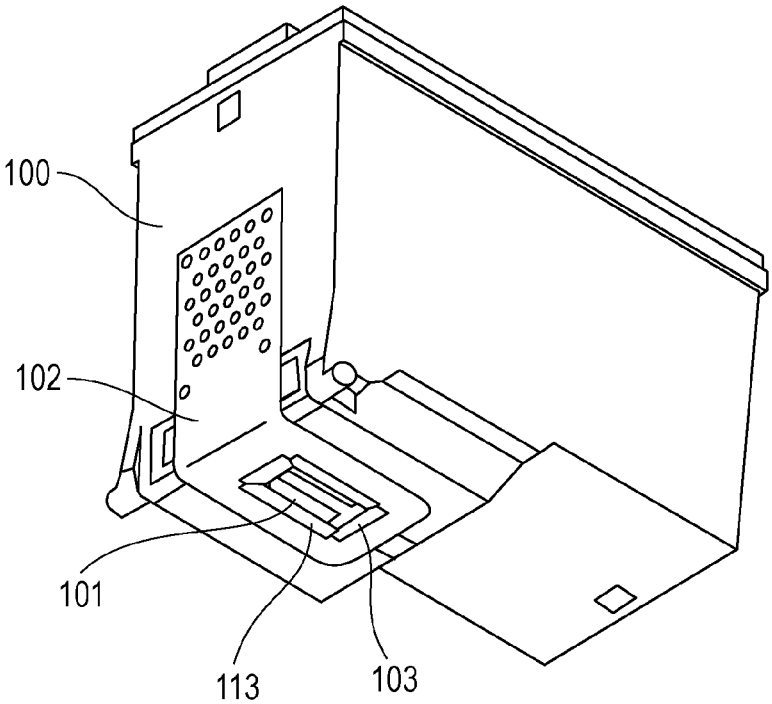
FIG. 1 is a perspective view of a recording head.

FIG. 1 is a perspective view illustrating a configuration of a recording head 100 of this disclosure. A chip 101 mounted on the recording head 100 is joined to an electrical wiring tape 102, and is in electrical contact with a carriage via the electrical wiring tape 102, whereby an electric signal is sent to a pressure generating element 106 to achieve a recording action. An electric joint portion of the electrical wiring tape 102 of the chip 101 is covered and protected by a seal member 103.

Figure 2:
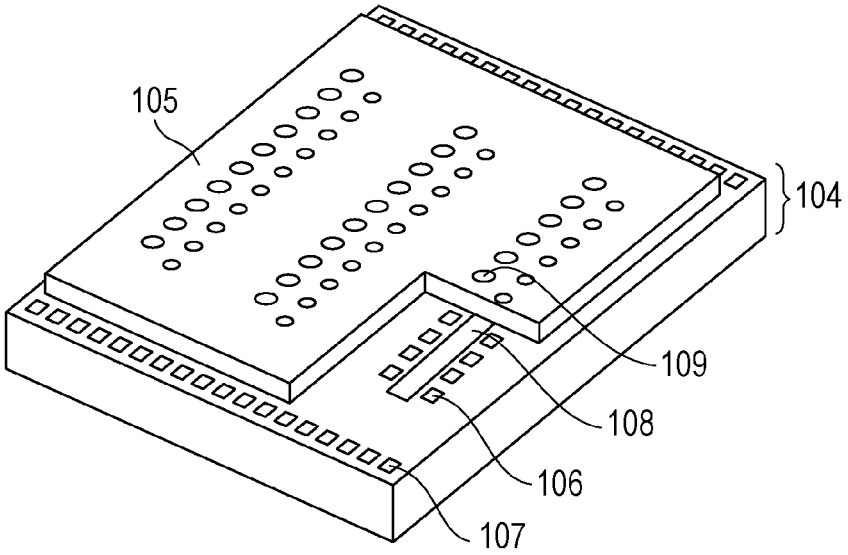
FIG. 2 is a perspective view of a chip.

FIG. 2 is a schematic view of the chip 101 provided on the recording head 100 of this disclosure. The chip 101 includes a substrate 104 and a channel forming member 105. The channel forming member 105 forms a flow channel of a recording material. Examples of the recording material include ink. Hereinafter, an example in which ink is used as the recording material will be described. The channel forming member 105 is formed of a resin or an inorganic material. The resin is preferably a photosensitive resin, and specifically, a negative type photosensitive resin is preferable. Examples of the inorganic material include SiO, SiN, SiC, and SiCN. The channel forming member 105 may be used also as a discharge port forming member. In FIG. 2, a discharge port 109 is formed in the channel forming member 105.

The substrate 104 is formed of, for example, silicon and is formed separately from a silicon wafer. The substrate 104 is provided with the pressure generating element 106 configured to discharge the ink, an electric wiring (not illustrated) formed of Al and the like for sending the electric signal to the pressure generating element 106, and an electric signal input terminal 107 configured to supply electric power to the electric wiring. The substrate 104 includes a supply port 108 configured to supply ink formed in the vicinity of the pressure generating element 106. The supply port 108 penetrates through the substrate 104. In FIG. 2, when the chip is viewed from above in a direction of penetration of the supply port 108 through the substrate 104, the supply port 108 has a rectangular shape. The ink is supplied from the supply port 108 to the flow channel in the channel forming member 105, receives energy from the pressure generating element 106, and is discharged from the discharge port 109. A front surface of the electric signal input terminal 107 that the substrate 104 has is provided with a layer formed of Au or the like by plating or the like. The chip 101 and the electrical wiring tape 102 are joined via the electric signal input terminal 107.

Figure 3A:
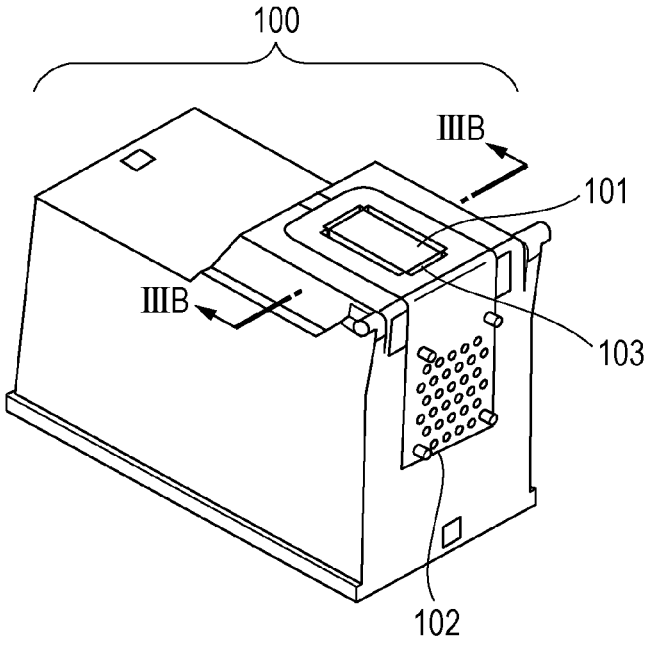
FIGS. 3A and 3B are a perspective view and a cross-sectional view of the recording head, respectively.
Figure 3B:
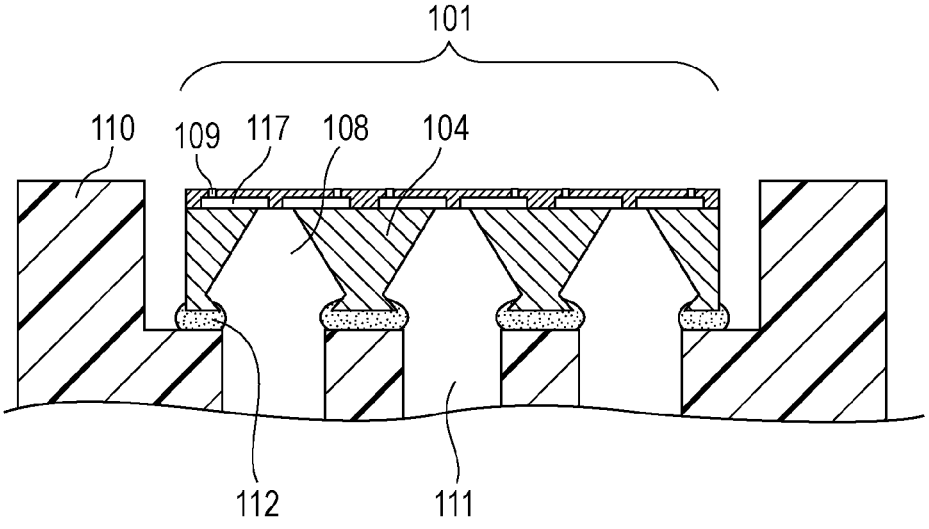

FIG. 3A is a perspective view illustrating a configuration of the general recording head 100. FIG. 3B is a cross-sectional view of the chip 101 of the recording head 100 taken along the line IIIB-IIIB of FIG. 3A. As illustrated in FIG. 3B, the chip 101 is arranged in a depressed portion of a supporting member 110. In other words, the substrate 104 is arranged in the depressed portion of the supporting member 110. The supporting member 110 is formed of a resin or alumina. The substrate 104 is adhered to the supporting member 110 via an adhesive agent 112. The adhesive agent 112 is formed of a composition cured by an ion polymerization reaction mechanism, for example, a UV-cured epoxy resin composition. Among the UV-cured epoxy resin compositions, a resin composition having a delayed curing property is preferable. As other examples of composition, in addition to a basic composition of a photo initiator and reaction diluent, fillers such as thixotropic agent, silane coupling agent, sensitizer may be included.

The supporting member 110 is formed with the opening portion 111, and the shape of the opening portion 111 corresponds to the shape of the supply port 108. Ink is supplied from the opening portion 111 to the supply port 108. A flow channel 117 and the supply port 108 provided in the channel forming member communicate each other. Therefore, the ink supplied to the supply port 108 is then supplied from the supply port 108 to the flow channel 117.

Figure 4:
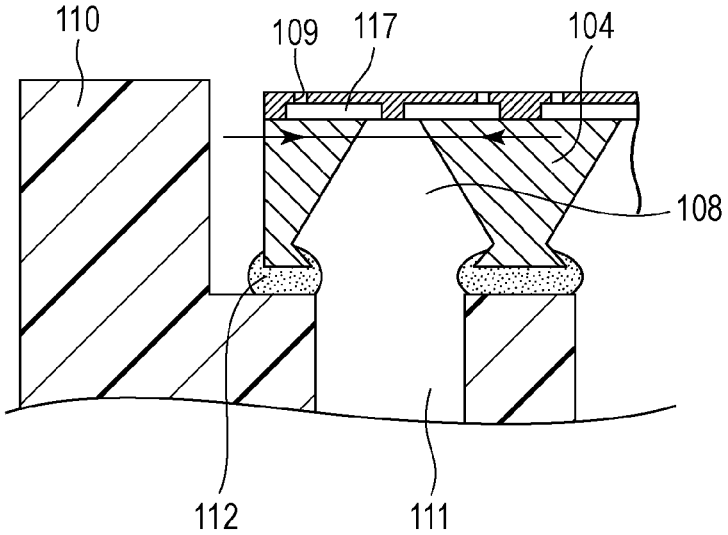
FIG. 4 is a cross-sectional view of the recording head.

In the case where the recording head 100 as illustrated in FIG. 3 is exposed to an abrupt environmental change, specifically, to an environment in which the temperature and the moisture change abruptly, a stress is exerted to the substrate 104 as illustrated in FIG. 4. Accordingly, the substrate 104 may be deformed. For example, the channel forming member 105 contracts and the contraction applies a bending stress to the substrate 104, whereby the substrate 104 is deformed. The same thing happens when the channel forming member 105 is expanded. As another case, the case where the substrate 104 is deformed due to contraction of the adhesive agent 112 is also conceivable.

Figure 5A:
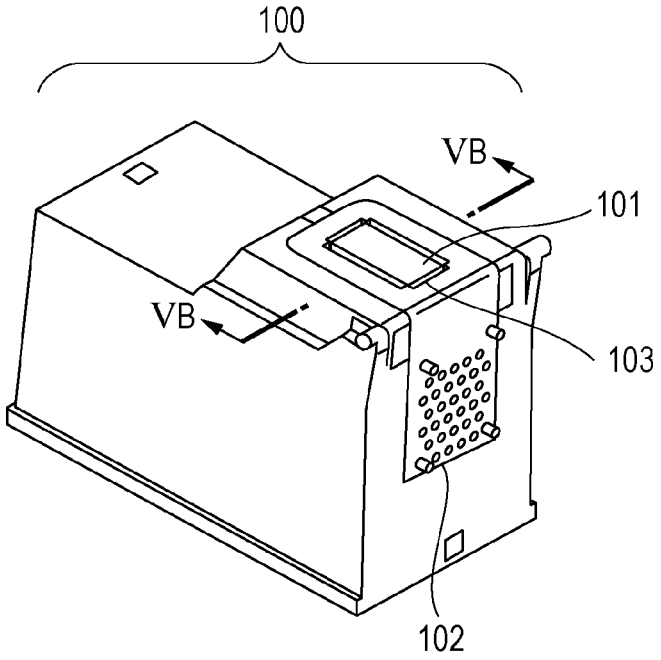
FIGS. 5A and 5B are a perspective view and a cross-sectional view of the recording head, respectively.
Figure 5B:
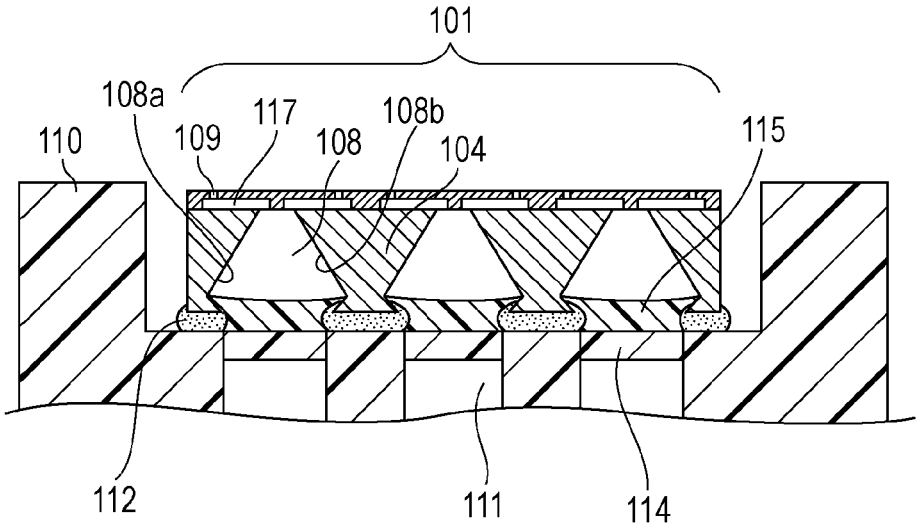

FIGS. 5A and 5B illustrate an example of the recording head of this disclosure. FIG. 5A is a perspective view illustrating the configuration of the recording head 100 of this disclosure. FIG. 5B is a cross-sectional view of the chip 101 of the recording head 100 taken along the line VB-VB of FIG. 5A. The recording head of this disclosure includes a member 115 formed of an organic material in an interior of the supply port 108 penetrating through the substrate 104. The member 115 formed of the organic material has a role of a beam structure of the substrate 104. A bridge structure 114 configured to support the member 115 is preferably formed below the member 115. The bridge structure 114 may be formed of part of the supporting member 110.

The member 115 forms the supply port 108, and connects two surfaces opposing each other with the supply port 108 interposed therebetween (for example, a surface 108*a* and a surface 108*b*). The two surfaces opposing each other with the supply port 108 interposed therebetween means two surfaces in a substantially opposing relationship. For example, also in the case where the supply port 108 has a column shape, parts of portions forming a side surface of the column opposing each other are considered to be two surfaces with the supply port 108 interposed therebetween. The opposing two surfaces are preferably parallel to each other.

Figure 6:
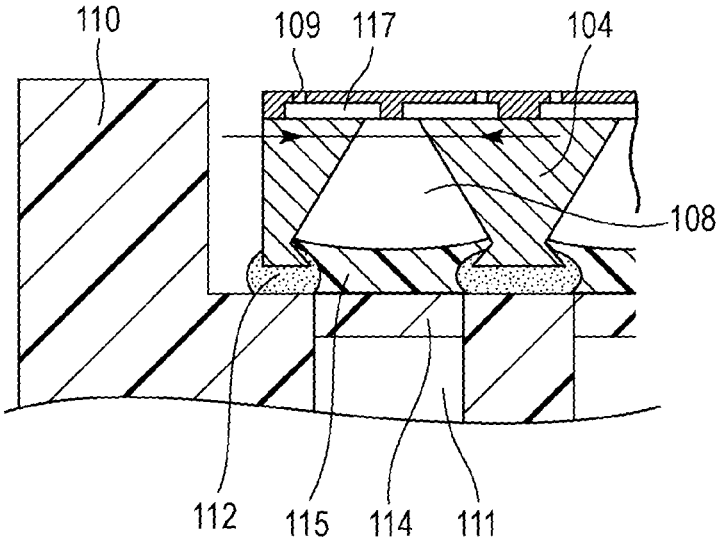
FIG. 6 is a cross-sectional view of the recording head.

FIG. 6 shows a state in which a stress is exerted to the substrate 104 of the recording head of this disclosure. As illustrated in FIG. 6, the member 115 has a role of the beam structure between opposing two surfaces with the supply port 108 interposed therebetween. Therefore, even though the contraction of the adhesive agent 112 occurs for example, a deformation of the substrate 104 may be restrained.

The two surfaces that the member 115 connects are preferably two surfaces opposing in a transverse direction of the supply port 108 when viewed from above in the direction of penetration of the supply port 108 through the substrate 104. The two surfaces are the surface 108*a* and the surface 108*b* in FIG. 5B. In contrast, the member 115 preferably does not connect the two surfaces opposing in a longitudinal direction of the supply port 108 when viewed from above in the direction of penetration of the supply port 108 through the substrate 104. When the opposing two surfaces are connected in the longitudinal direction, there is a tendency that a desirable ink flow cannot be achieved.

The member 115 is formed of an organic material. The member 115 is exposed to the recording material, and hence a material having resistivity against liquid, specifically ink is preferable. For example, an acrylic resin composition of radical polymerization system or an epoxy-based resin composition of ion polymerization system is preferable. The size of the member 115 depends on dimensions of the supply port 108. However, a lateral width in a range from 400 μm to 1200 μm is preferable for a cross section illustrated in FIG. 6. A height of the cross section illustrated in FIG. 6 in a vertical direction preferably falls within a range from 50 μm to 300 μm. The height of the member 115 is preferably not larger than 70%, further preferably not larger than 50%, and still further preferably not larger than 40% of a depth of the supply port 108 when the flow of the ink is considered. In view of the strength as the beam structure, the height of the member 115 is preferably not smaller than 5%, more preferably not smaller than 10%, and further preferably not smaller than 20%. The height of the member 115 corresponds to a height of a portion including a portion in the interior of the supply port 108, and a lateral portion of the adhesive agent 112 illustrated in FIG. 6. The depth of the supply port 108 here is not only an interior of the substrate 104, but also includes the portion on the side of the adhesive agent 112. When considering the manufacturing process, the member 115 is preferably formed in the interior of the supply port 108 on a side of the substrate 104 close to a surface on the opposite side from the side on which the pressure generating element 106 is formed.

In particular, when considering the contraction and expansion of the adhesive agent 112, the organic material that forms the member 115 and the adhesive agent 112 that form the member 115 are preferably the same material. The same material does not mean only completely the same material including the molecular weight. For example, if both are included in the category of the epoxy resin, it may be regarded as the same material. More preferably, the adhesive agent 112 and the member 115 are formed of one material. By using the same material, forces work to cancel each other, so that the deformation of the substrate may be restrained desirably.

As illustrated in FIG. 6, under the environment in which the temperature and the moisture change abruptly, a rigidity K of the member 115 with respect to a bending stress may be expressed as "$K=E\times I$", where E is a vertical elastic coefficient and I is a cross-sectional secondary moment of the member 115.

Figure 7A:
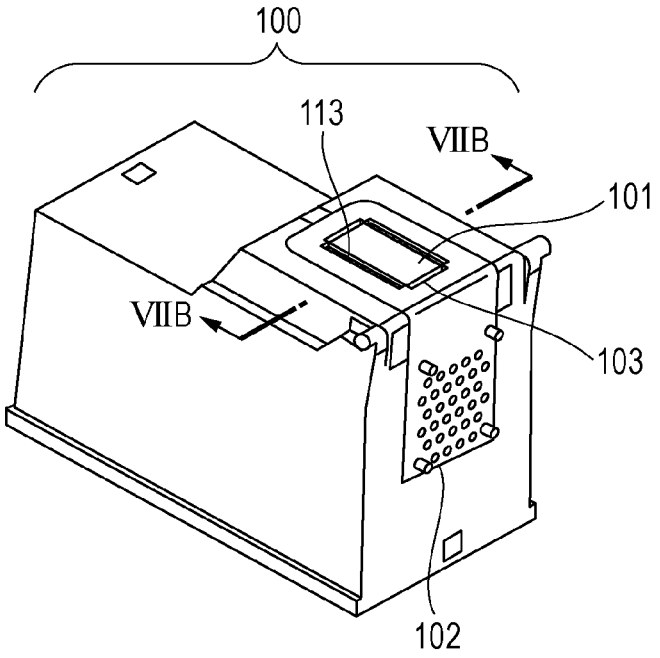
FIGS. 7A and 7B are a perspective view and a cross-sectional view of the recording head, respectively.
Figure 7B:
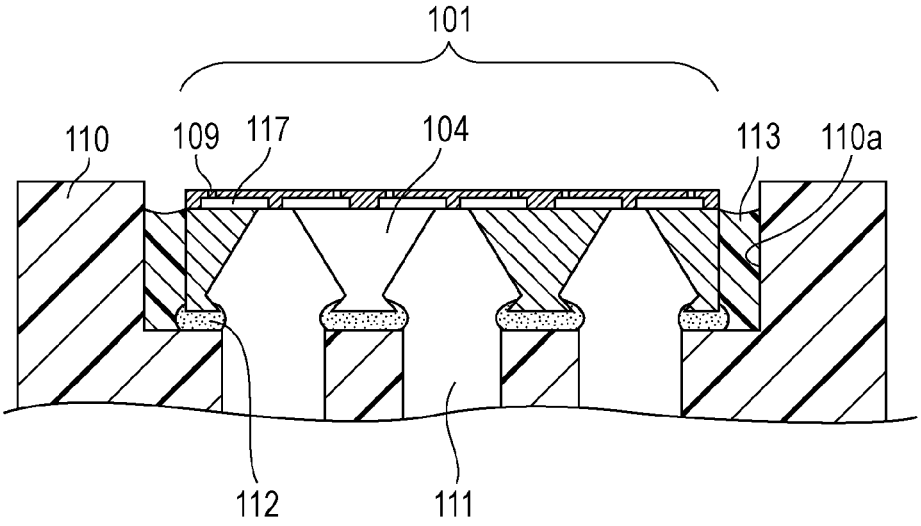

FIGS. 7A and 7B are views illustrating a recording head which is similar to that described in conjunction with FIGS. 5A and 5B. An area between walls 110*a* of the supporting member, which forms the depressed portion, and the substrate 104 is sealed with the sealing member 113. The sealing member 113 needs only to be arranged in at least part of the area between the walls 110*a* and the substrate 104. In particular, the sealing member 113 is preferably arranged so as to cover side surfaces of the substrate 104 along the longitudinal direction when viewing from above in the direction in which the supply port 108 penetrates through the substrate 104 (in other words, the direction on the upper side in FIG. 7B).

Figure 8:
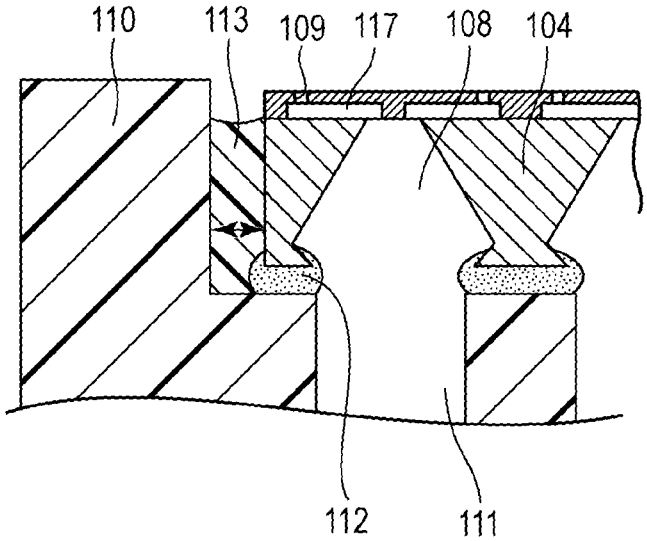
FIG. 8 is a cross-sectional view of the recording head.

When the sealing member 113 is arranged as illustrated in FIGS. 7A and 7B, a stress may be exerted on the substrate 104 by contraction of the sealing member 113. FIG. 8 illustrates a state in which the sealing member 113 contracts. When the sealing member 113 contracts, a tensile force different from the bending stress acts on the substrate 104 and induce a deformation. Accordingly, the substrate may be deformed. The same applies to the case where the sealing member 113 is expanded.

Figure 9A:
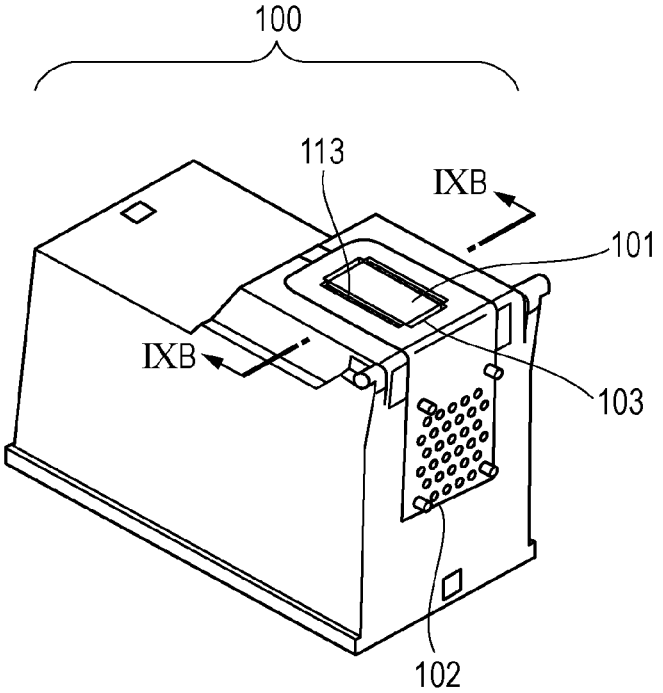
FIGS. 9A and 9B are a perspective view and a cross-sectional view of the recording head, respectively.
Figure 9B:
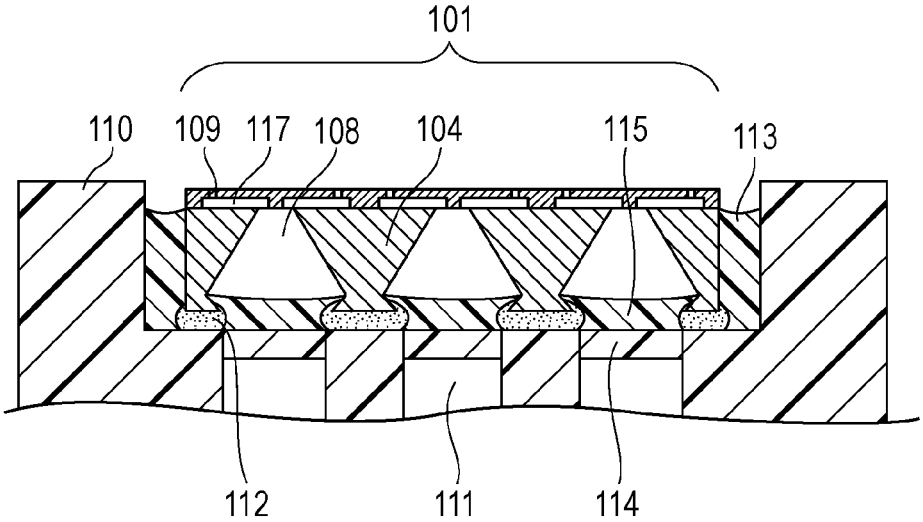
Figure 10:
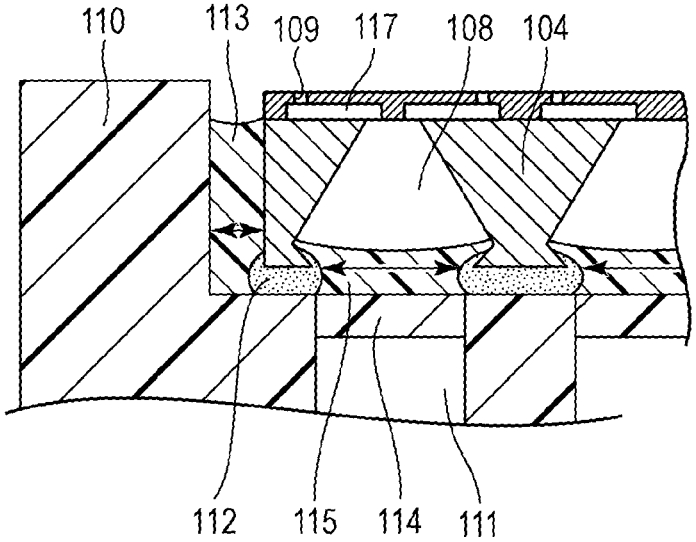
FIG. 10 is a cross-sectional view of the recording head.

Accordingly, as illustrated in FIGS. 9A and 9B and FIG. 10, the member 115 formed of an organic material in the interior of the supply port 108 penetrating through the substrate 104 is provided in this disclosure. The member 115 and a peripheral portion thereof are basically the same as those described in conjunction with FIGS. 5A and 5B, and FIG. 6. However, when the sealing member 113 is formed, the member 115 may be contracted and expanded in coordination with the contraction and the expansion of the sealing member 113. Therefore, the stress generated with respect to the substrate 104 may be desirably alleviated.

In particular, when considering the contraction and the expansion of the sealing member 113, the organic material that forms the member 115 and the sealing member 113 that form the member 115 are preferably the same material. The same material does not mean only completely the same material including the molecular weight. For example, if both are epoxy resin, it may be regarded as the same material. More preferably, the sealing member 113 and the member 115 are formed of one material. By using the same material, forces work to cancel each other, so that the deformation of the substrate may be restrained desirably. In particular, when the materials of the sealing member 113 and the member 115 are mated each other, an effect of cancellation is remarkable because of the structure of the recording head.

In the case illustrated in FIGS. 9A and 9B, a thermal stress σ generated with respect to an abrupt temperature change may be expressed as follows.

$$\Sigma = E \times \alpha \times \Delta T$$

σ: thermal stress, E: vertical elastic coefficient, α: coefficient of linear expansion, ΔT: temperature change In addition, an external force R caused by the thermal stress where A is a surface area between different materials constrained to each other is expressed as follows.

$$R = \sigma \times A$$

In other words, an external force $R_X$ generating in the channel forming member 105 and an external force $R_Y$ generating in the member 115 are preferably equivalent when placing the channel forming member 105 and the member 115 illustrated in FIGS. 9A and 9B on the same line viewing a cross section in a transverse direction of the chip 101. When considering that the temperature change has no big difference from one member to another, the following expression is preferably satisfied, where $A_X$ is a cross-sectional area in a direction parallel to the transverse direction of the substrate 104 of the sealing member 113, $\alpha_X$ is a coefficient of linear expansion, $E_X$ is a vertical elastic coefficient, $A_Y$ is a cross-sectional area in a direction parallel to the transverse direction of the substrate 104 of the member 115 formed of an organic material, $\alpha_Y$ is a coefficient of linear expansion, and $E_Y$ is a vertical elastic coefficient.

$$(A_X \times \alpha_X \times E_X)/(A_Y \times \alpha_Y \times E_Y) = 0.8 \text{ to } 1.2$$

By satisfying the expression given above, the external force $R_X$ of the sealing member 113 and the external force $R_Y$ of the member 115 acts on and alleviates each other as illustrated in FIG. 10, damage of the substrate 104 may be restrained. If the ratio of the external force of the sealing member 113 and the external force of the member 115 falls within a range from 0.8 to 1.2, the deformation of the substrate can easily be restrained.

Figure 11A:
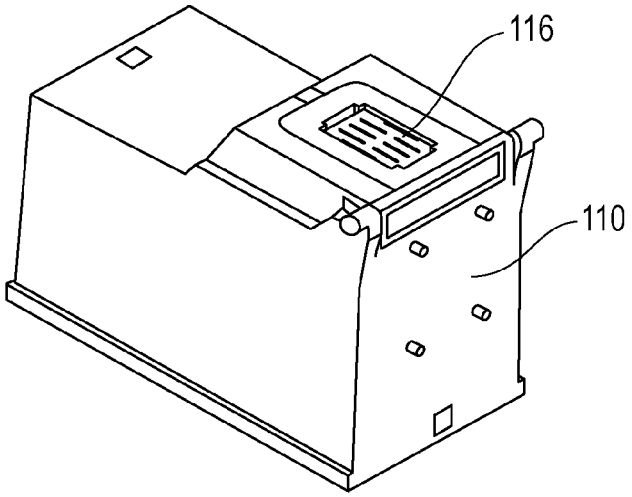
FIGS. 11A to 11C are drawings illustrating a process of manufacture of the recording head.
Figure 11B:
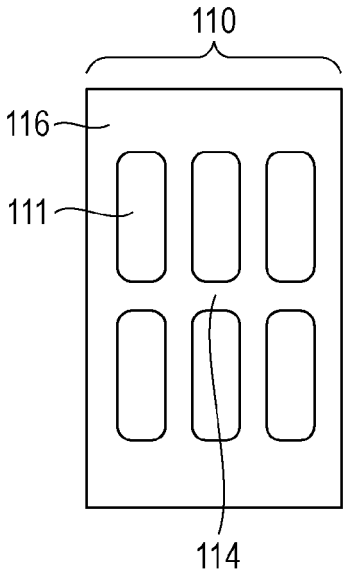
Figure 11C:
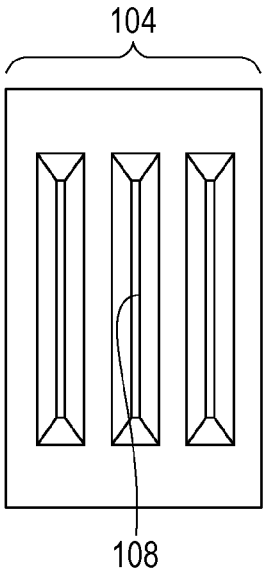

Referring now to FIGS. 11A to 11C and FIGS. 12A to 12C, an example of a method of manufacturing the recording head of this disclosure will be described. FIG. 11A is a perspective view of the recording head 100, FIG. 11B is an enlarged view of a bonding surface 116 of the supporting member, and FIG. 11C is an enlarged view of a back side of the chip 101 adhered to the bonding surface 116. The bonding surface 116 is provided with the opening portion 111 formed into a shape corresponding to the supply port 108 of the substrate 104. The bonding surface 116 is provided with the bridge structure 114 formed thereon.

Figure 12A:
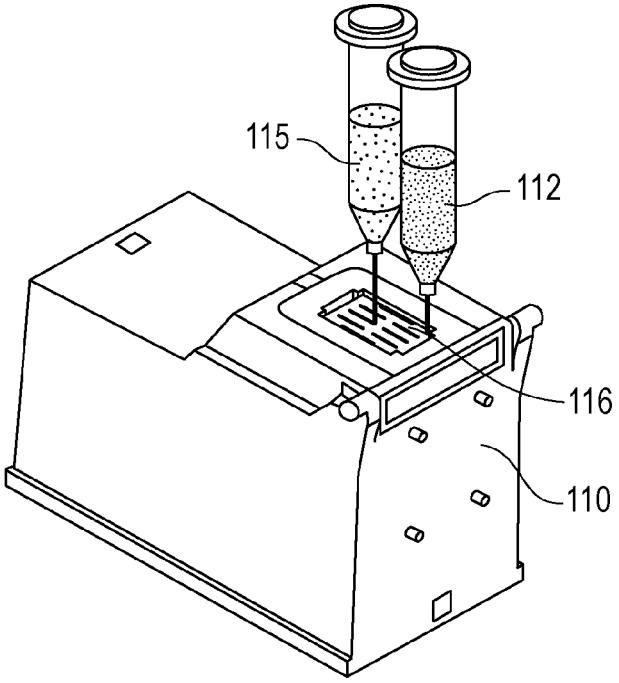
FIGS. 12A to 12C are drawings illustrating the process of manufacture of the recording head.
Figure 12B:
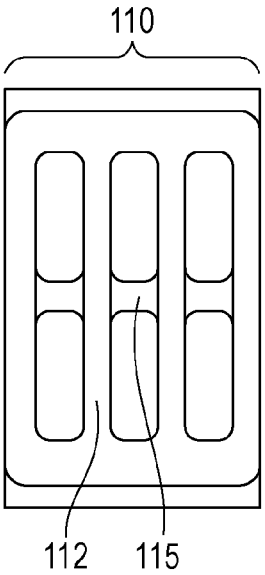

In this manner, as illustrated in FIGS. 12A and 12B, the supporting member having a depressed portion formed thereon is prepared, and the member 115 is formed by applying the organic material on the bridge structure 114 of the bonding surface 116 of the supporting member. Subsequently, the adhesive agent 112 is applied to at least part of a portion of the bonding surface 116 of the supporting member other than the bridge structure 114. The reason why the portion other than the bridge structure is specified is that the member 115 is formed on the bridge structure.

Figure 12C:
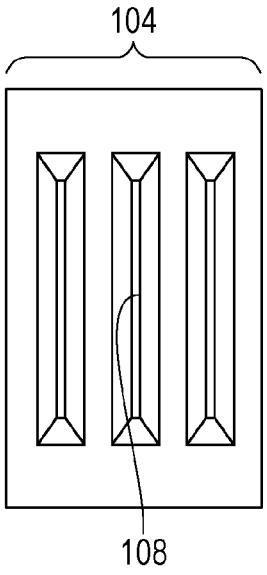

Subsequently, the substrate 104 illustrated in FIG. 12C is joined to the bonding surface 116. In other words, although the substrate 104 is arranged on the member 115, and the member 115 is arranged in the interior of the supply port 108. The substrate 104 and the bonding surface 116 of the supporting member are joined to each other over portions other than the portion where the supply port 108 is formed via the adhesive agent 112.

Then, sealing is performed by using the seal member 103 and the sealing member 113 as needed and heating is performed, so that the recording head is manufactured.

EXAMPLES

With reference to examples, this disclosure will be described in further detail.

Example 1

First of all, the chip 101 was manufactured in accordance with the following method.

A positive photosensitive resin composition (Name of Product: ODUR, manufactured by TOKYO OHKA KOGYO CO., LTD.) was applied on the substrate 104 formed of silicon by spin coating. By exposing and developing the composition, a die member which becomes a base of the flow channel of ink was formed. Subsequently, a negative photosensitive resin composition (Name of Product: SU-8-3025, manufactured by Nippon Kayaku Co., Ltd.) was applied so as to cover the die member by spin coating. The applied negative photosensitive resin was exposed via a photomask, and then areas which were not exposed were removed by developing liquid, whereby the discharge port 109 was formed by pattern formation.

Subsequently, the supply port 108 penetrating through the substrate 104 was formed by performing wet etching on the substrate 104 by tetramethylammonium hydroxide with a mask of a thermally-oxidized film (not illustrated), and the supply port 108 penetrating through the substrate 104 was formed. Subsequently, the die member was melted out from the supply port 108. In this manner, the channel forming member 105 was formed from the negative photosensitive resin.

Subsequently, the chip 101 and the electrical wiring tape 102 were joined to each other. The joint between the chip 101 and the electrical wiring tape 102 was achieved by thermocompression bonding between the electrical wiring tape 102 and Au provided on a surface of the electric signal input terminal 107 of the substrate 104.

The thickness of the substrate 104 was 700 μm. The width of the supply port 108 in the transverse direction was 500 μm.

The chip 101 and the electrical wiring tape 102 manufactured in this manner were adhered to the bonding surface 116 on the supporting member 110 formed of alumina as illustrated in FIGS. 11A to 11C.

Subsequently, as illustrated in FIGS. 12 A to 12C, the adhesive agent 112 was applied and the member 115 was further applied thereto. Specifically, the adhesive agent 112 was applied to the bonding surface 116 and the member 115 was applied on the bridge structure 114 by a drawing application method using a needle while moving the needle. The adhesive agent 112 was formed of an epoxy resin composition (Name of Product: KS-820, manufactured by ADEKA). The member 115 was formed of an epoxy resin composition (Name of Product: KR-827, manufactured by ADEKA) different from the adhesive agent 112. The thickness of the adhesive agent 112 was 150 μm, and the thickness of the member 115 was 200 μm.

Subsequently, the chip 101 and the electrical wiring tape 102 were joined to the supporting member 110, and a fixing process was performed. The member 115 was arranged so as to connect the two surfaces opposing each other with the supply port 108 interposed therebetween. A butadiene series epoxy resin (Name of Product: NR200C, manufactured by SANYU REC CO. LTD.) was applied in a periphery of the chip 101, and heated at 110° C. and cured. In this manner, the seal member 103 and the sealing member 113 are formed. As regards the seal member 103 and the sealing member 113, as illustrated in FIG. 1, the seal members 103 were formed at both end portions of the chip 101 in the longitudinal direction, and the sealing members 113 were formed at both end portions of the chip 101 in the transverse direction.

As a result of observation of the substrate 104 of the recording head 100 manufactured in this manner, no deformation of the substrate was observed.

Example 2

In example 1, the different materials were used for the adhesive agent 112 and the organic material, which was a material forming the member 115. However, in Example 2, the material of the member 115 was changed so that the materials of the adhesive agent 112 and the organic material, which is the material forming the member 115, became the same material. In other words, the adhesive agent 112 and the member 115 were formed of the epoxy resin composition (Name of Product: KS-820, manufactured by ADEKA). Since the adhesive agent 112 and the member 115 were formed of the same material, the needle was shared, and the adhesive agent 112 and the member 115 were formed in one lump. Other points were the same as those in Example 1.

As a result of observation of the substrate 104 of the recording head 100 manufactured in this manner, no deformation of the substrate was observed.

When comparing with Example 1, application of the adhesive agent 112 and application of the member 115 could be performed in one lump, so that the recording head could be manufactured simply with a smaller number of steps.

Example 3

Figure 13A:
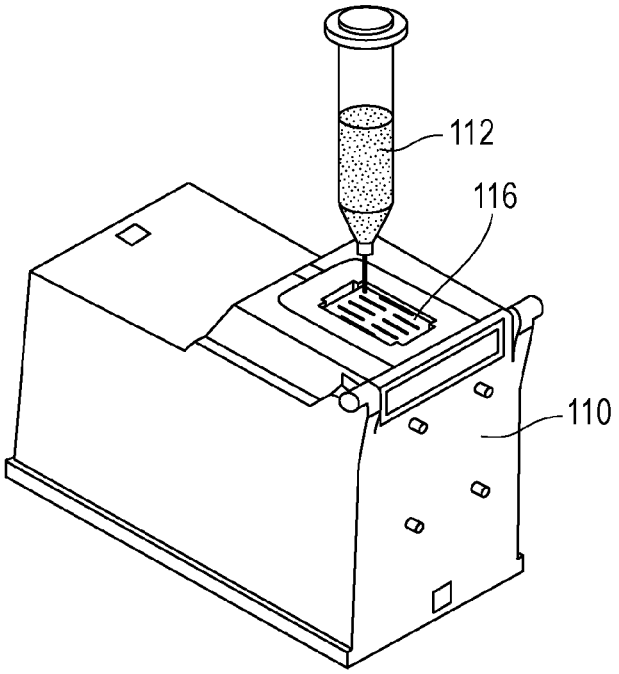
FIGS. 13A to 13C are drawings illustrating the process of manufacture of the recording head.
Figure 13B:
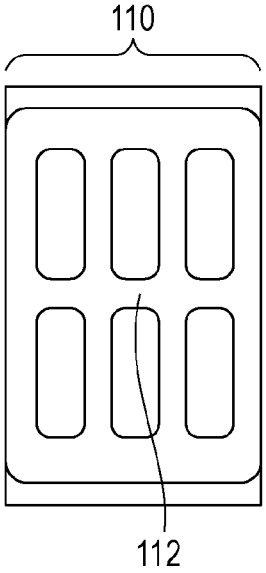
Figure 13C:
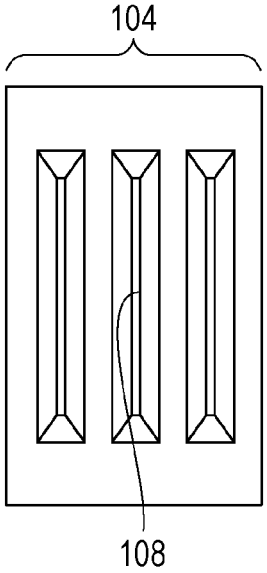

In Example 1, the different materials were used for the sealing member 113 and the organic material, which was a material forming the member 115. However, in Example 3, the material of the member 115 was changed so that the materials of the sealing member 113 and the organic material, which is the material forming the member 115, the material forming the member 115 became the same material. In other words, the sealing member 113 and the member 115 were formed of the butadiene series epoxy resin (Name of Product: NR200C, SANYU REC CO. LTD). Since the sealing member 113 and the member 115 were formed of the same material, the needle was shared, and the recording head was manufactured as illustrated in FIGS. 13A to 13C. Other points were the same as those in Example 1.

As a result of observation of the substrate 104 of the recording head 100 manufactured in this manner, no deformation of the substrate was observed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-100913 filed May 14, 2014 which is hereby incorporated by reference herein in its entirety.

What is claimed is:

1. A recording head comprising:

a substrate and a channel forming member configured to form a flow channel;

a supply port formed at the substrate so as to penetrate through the substrate and the flow channel communicates with the supply port;

an interconnecting member formed of an organic material and configured to connect two surfaces forming the supply port and opposing each other with the supply port interposed therebetween, wherein the two surfaces oppose each other in a transverse direction of the supply port when viewed from above in a direction in which the supply port penetrates through the substrate; and a rigid bridge structure configured to also interconnect the two surfaces forming the supply port, while also providing an upper support surface to provide structural support for a bottom surface of the interconnecting member, so that the upper support surface of the bridge structure is in direct contact with the bottom surface of the interconnecting member, wherein the interconnecting member formed of the organic material does not connect the two surfaces opposing each other in a longitudinal direction of the supply port when viewed from above in a direction in which the supply port penetrates through the substrate, wherein the substrate is arranged in a depressed portion of a supporting member.

2. The recording head according to claim 1, wherein an area between a wall of the supporting member forming the depressed portion and the substrate is at least partly sealed with a sealing member.

3. The recording head according to claim 2, wherein the sealing member is made of the same material as the organic material.

4. The recording head according to claim 2, wherein the expression $(Ax \times ax \times Ex)/(Ay \times ccy \times Ey)=0.8$ to 1.2 is satisfied, where Ax is a cross-sectional area in a direction parallel to a transverse direction of the substrate of the sealing member, ax is a coefficient of linear expansion, Ex is a vertical elastic coefficient, Ay is a cross-sectional area in a direction parallel to the transverse direction of the substrate of the interconnecting member formed of an organic material, cy is a coefficient of linear expansion, and Ey is a vertical elastic coefficient.

5. The recording head according to claim 1, wherein the substrate and the supporting member are adhered to each other with an adhesive agent.

6. The recording head according to claim 5, wherein the adhesive agent is the same material as the organic material.

7. The recording head according to claim 1, wherein a height of the interconnecting member formed of the organic material is 5% or more of a depth of the supply port.

8. The recording head according to claim 1, wherein a height of the interconnecting member formed of the organic material is 70% or less of a depth of the supply port.

9. A method of manufacturing the recording head according to claim 1, comprising:

preparing the interconnecting member formed of an organic material; and arranging a substrate on the interconnecting member formed of the organic material so that the interconnecting member formed of the organic material is arranged in an interior of the supply port.

10. The method of manufacturing the recording head according to claim 9, wherein the interconnecting member formed of the organic material is formed directly on the rigid bridge structure.

11. The method of manufacturing the recording head according to claim 9, wherein an adhesive agent is formed on the supporting member, and the substrate and the supporting member are joined via the adhesive agent at a portion other than the portion where the supply port is formed.

12. The method of manufacturing the recording head according to claim 11, wherein the adhesive agent and the organic material are formed of the same material, and the adhesive agent and the organic material are formed in one lump.

* * * * *